US007356855B1

(12) United States Patent
Morad et al.

(10) Patent No.: US 7,356,855 B1
(45) Date of Patent: Apr. 15, 2008

(54) SMILEY FACE TOILET SEAT COVER FOR EASILY TEARING OFF A CENTER PORTION OF THE COVER AND RAPIDLY FLUSHING THE COVER DOWN THE TOILET

(75) Inventors: Fred I. Morad, Toluca Lake, CA (US); Todd M. Carlson, Moreland Hills, OH (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 11/635,454

(22) Filed: Dec. 5, 2006

(51) Int. Cl.
*A47K 13/14* (2006.01)
*A47K 13/16* (2006.01)

(52) U.S. Cl. ..... 4/245.1; 4/245.3; 4/245.9

(58) Field of Classification Search ..... 4/244.1–245.9
See application file for complete search history.

(56) References Cited

U.S. PATENT DOCUMENTS

| | | | | |
|---|---|---|---|---|
| 1,248,077 | A | 11/1917 | Chase | |
| 1,452,552 | A | 4/1923 | Frear | |
| 1,702,070 | A | 2/1929 | Young | |
| 1,761,391 | A | 6/1930 | Harris | |
| 1,847,131 | A * | 3/1932 | Moore | 4/244.1 |
| D174,213 | S | 3/1955 | Brito | |
| 2,984,383 | A * | 5/1961 | Arneson | 206/184 |
| 4,264,992 | A | 5/1981 | Tromp | |
| 4,766,617 | A * | 8/1988 | Thygesen et al. | 4/245.4 |
| 4,875,242 | A | 10/1989 | Albrecht et al. | |
| D320,069 | S | 9/1991 | Rossiter | |
| D451,178 | S | 11/2001 | Massey | |
| 6,968,578 | B2 | 11/2005 | Bernsley | |

FOREIGN PATENT DOCUMENTS

| | | |
|---|---|---|
| EP | 0628278 | 12/1994 |
| WO | WO 99/34720 | 7/1999 |

* cited by examiner

*Primary Examiner*—Khoa D. Huynh
*Assistant Examiner*—Kristie A. Mahone
(74) *Attorney, Agent, or Firm*—Thomas I. Rozsa

(57) ABSTRACT

A generally rectangular shaped disposable paper sheet for use as a toilet seat cover, comprising a die cut line shaped as an open ended oval, which divides the sheet into a central elongated ovally shaped portion and an outer seat covering portion. Within the central portion of the seat cover, there are a pair of finger holes and an additional discrete arcuate perforation. Each finger hole is not fully cut in 360 degrees but has a portion that is retained onto the central portion of the paper sheet so that, when the finger hole is used to tear the die cut line, the retained portion increases strength of the finger hole, which promotes more easily and efficiently tearing the entire central portion downwardly away from the outer covering portion which rests on and covers the toilet seat. The arcuate perforation enables the toilet seat cover to be more efficiently and rapidly flushed down the toilet bowl due to ability that the toilet water to pass through the perforation.

26 Claims, 1 Drawing Sheet

SMILEY FACE TOILET SEAT COVER FOR EASILY TEARING OFF A CENTER PORTION OF THE COVER AND RAPIDLY FLUSHING THE COVER DOWN THE TOILET

BACKGROUND OF THE INVENTION

1. Field of the Invention

The present invention is related to a disposable paper sheet used as a toilet seat cover for sanitary purpose.

2. Description of the Prior Art

The following 13 patents and published patent applications are the closest prior art references which are related to the present invention.

1. U.S. Pat. No. 1,284,077 issued to Luna May Ennis on Nov. 5, 1918 for "Sanitary Seat Cover For Toilets" (hereafter the "Ennis patent");
2. U.S. Pat. No. 1,452,552 issued to Leo J. Frear on Apr. 24, 1923 for "Sanitary Seat Cover" (hereafter the "Frear patent");
3. U.S. Pat. No. 1,702,070 issued to Thomas L. Young on Feb. 12, 1929 for "Sanitary Toilet Seat Cover" (hereafter the "Young patent");
4. U.S. Pat. No. 1,761,391 issued to Clara F. Harris on Jun. 3, 1930 for "Sanitary Shield For Toilet Seats" (hereafter the "Harris patent");
5. U.S. Design Pat. No. Des. 174,213 issued to Jose Brito on Mar. 15, 1955 for "Disposable Paper Toilet Seat Cover" (hereafter the "Brito Design patent");
6. U.S. Pat. No. 4,264,992 issued to Geradus M. Tromp on May 5, 1981 for "Paper Sheet Cartridge" (hereafter the "Tromp patent");
7. U.S. Pat. No. 4,766,617 issued to Eskild G. Thygesen et al. on Aug. 30, 1988 for "Disposable Sanitary Toilet Seat Cover" (hereafter the "Thygesen patent");
8. U.S. Pat. No. 4,875,242 issued to Leonard N. Albrecht et al. and assigned to Alvin S. Haining et al. on Oct. 24, 1989 for "Compact Toilet Seat Cover" (hereafter the "Albrecht patent");
9. U.S. Design Pat. No. Des. 320,069 issued to Jean T. Rossiter on Sep. 17, 1991 for "Toilet Seat Cover" (hereafter the "Rossiter Design patent");
10. U.S. Design Pat. No. D451,178 issued to William Yates Massey, Jr. on Nov. 27, 2001 for "Portable Toilet Seat Cover" (hereafter the "Massey Design patent");
11. U.S. Pat. No. 6,968,578 issued to Mark Bernsley on Nov. 29, 2005 for "Child's Disposable Toilet Seat Adaptor With Side Handles And Fold-Under Flap" (hereafter the "Bernsley patent");
12. European Patent Application No. 0,628,278 issued to Walter J. Breyer and assigned to Scott Paper Company on Dec. 14, 1994 for "Flushable, Laminated Toilet Seat Cover" (hereafter the "Breyer European Patent Application");
13. International Application No. WO 99/34720 issued to Josef Kodet et al. on Jul. 15, 1999 for "Sanitary Toilet Seat Cover" (hereafter the "Kodet International Application").

The Ennis patent which issued in 1918 is a seat cover for toilets. It discloses a slot cut portions B which can be used to separate the center section from the body of the cover.

The Frear patent which issued in 1923 is also a roll of sanitary covers which is attached to the toilet and which can be pulled by tabs 8 to remove one seat cover from the roll of seat covers.

The Young patent which issued in 1929 is a sanitary toilet seat cover which has flaps which are designed to hang onto the interior of the bowl to facilitate the carrying away of the cover in the flushing operation.

The Harris patent which issued in 1930 is also a sanitary cover. It discloses a use of tabs 20 by which the seat cover may be removed from the toilet seat after use.

The Brito patent which issued in 1955 is a design patent which protects the shape of a toilet seat cover.

The Tromp patent is a paper sheet cartridge which discloses having longitudinally extending slits 35 and 37 forming a curve out of portion 39 and a central tongue 41. There are two slits 57 and 58 shown but these don't serve any functional purpose.

The Thygesen patent which issued in 1988 discloses a disposable sanitary toilet seat cover. It discloses a finger hole 6 which can be used for gripping in the process of tearing off the central potion. However, the disadvantage of the Thygesen invention is that the finger hole is located on the edge of the central portion which is bounded by a die cut line, wherein a part of the edge of the finger hole is aligned with the die cut line. Therefore, the finger hole disappears once it is used to tear a portion of the interior section of the die cut line away from the remainder of the toilet seat cover.

The Albrecht patent discloses a compact toilet seat cover which includes a small piece of tape 58 and a protective liner 62.

The Rossiter patent discloses the design for a toilet seat cover.

The Massey patent is a design patent, which discloses a portable toilet seat cover. There is a groove which is shown at the bottom but is unclear what purpose it serves.

The Bernsley patent is a disposable toilet seat cover which has more of a solid cover designed so that a child can sit on the toilet and not fall in.

The Breyer European Patent Application discloses a flushable toilet seat cover which can dissolve when it falls into the toilet seat.

Finally, the Kodet International Patent Application discloses a sanitary toilet seat cover which consists of two water soluble layers so that it can dissolve in the toilet.

There is a significant need to significantly improve the ability to tear away the center portion of a die cut toilet seat cover to more efficiently enable the seat cover to be flushed down the toilet bowl.

SUMMARY OF THE INVENTION

The present invention relates to a generally rectangular shaped disposable paper sheet for use as a toilet seat cover, comprising a die cut line shaped as an open ended oval, which divides the sheet into a central elongated ovally shaped portion and an outer seat covering portion. More particularly, the present invention relates to the addition of a pair of finger holes which are not fully cut in 360 degrees but have a portion that is retained onto the central portion of the paper sheet so that when the finger holes are used to tear the die cut line, the retained portion increases strength of the finger holes, which promotes more easily and efficiently tearing the entire central portion downwardly away from the outer covering portion which rests on and covers the toilet seat. In addition, the present invention further includes a discrete arcuate perforation cut into the central portion of the paper sheet which is placed below the pair finger holes, so that the curved perforation enables the toilet seat cover to be more efficiently and rapidly flushed down the toilet bowl.

It has been discovered, according to the present invention, that if a pair of finger holes which are not fully cut in 360 degrees but have a portion that is retained onto a central portion are placed into the central elongated ovally shaped portion of a generally rectangular paper sheet which is used as a toilet seat cover, wherein the central portion is bounded by a die cut line shaped as an open ended oval and the pair of holes are placed transversely to an imaginary centerline of the sheet, then the central portion of the sheet will be more easily and entirely torn along the die cut line when respective fingers are inserted into the pair of finger holes which have increased strength due to the retained portion so that pulling the center section through these holes enables the center section to be more efficiently torn away from the toilet seat cover.

It has also been discovered, according to the present invention, that if an additional discrete arcuate perforation which is added within the central portion of the toilet seat cover is transversely and symmetrically placed relative to an imaginary centerline of the central portion, and located closer to the middle of the central portion than the pair finger holes, then the toilet seat cover sheet will be more rapidly flushed down the toilet bowl because water can be flushed through the arcuate perforation.

It has been additionally discovered, according to the present invention, that if at least one finger hole which is not cut in 360 degrees but has a portion that is retained onto the central portion is placed into a central elongated ovally shaped portion of a generally rectangular paper sheet which is used as a toilet seat cover, wherein the central portion is bounded by a die cut line shaped as an open ended oval and the at least one finger hole is placed transversely to an imaginary centerline of the sheet, the central portion of the sheet will be more easily and entirely torn along the die cut line when a finger is inserted into the at least one finger hole to tear the center portion away from the outer seat covering portion.

It has further been discovered, according to the present invention, that if an additional arcuate perforation which is comprised of multiple discrete sections is added within the central portion of the toilet seat cover, then the toilet seat cover sheet will be more rapidly flushed down the toilet bowl because the toilet water can be flushed through the perforation.

It is therefore an object of the present invention to provide a pair of finger holes which are not fully cut in 360 degrees but have a portion that is retained onto a central portion which are placed into a central elongated ovally shaped portion of a generally rectangular paper sheet which is used as a toilet seat cover, wherein the central portion is bounded by a die cut line shaped as an open ended oval and the pair of holes are placed transversely to an imaginary centerline of the sheet, so that the central portion of the sheet will be more easily and entirely torn along the die cut line when a respective finger is respectively inserted in a respective one of the pair of finger holes and are used to tear the center portion away from the outer seat covering portion. Since each finger hole is partially Retained onto the center portion, each hole has increased strength to reduce the hole itself being torn during this process.

It is also an object of the present invention to provide an additional discrete arcuate perforation which is added within the central portion of the toilet seat cover, is transversely and symmetrically placed relative to an imaginary centerline of the central portion, and is located closer to the center of the portion than the pair of finger holes, so that the toilet seat cover sheet will be more rapidly flushed down the toilet bowl because the toilet water can be flushed through the arcuate perforation.

It is an additional object of the present invention to provide at least one finger hole which is not cut in 360 degrees but has a portion that is retained onto a central portion which is placed into a central elongated ovally shaped portion of a generally rectangular paper sheet which is used as a toilet seat cover, wherein the central portion is bounded by a die cut line shaped as an open ended oval and the at least one finger hole is placed transversely to an imaginary centerline of the sheet, so that the central portion of the sheet will be more easily and entirely torn along the die cut line when at least one finger hole is used to tear the center portion away from the outer seat covering portion. Since the hole is partially attached to the center portion, it has increased strength to reduce the possibility that the hole itself will be torn during this process.

It is a further object of the present invention to provide an additional perforation which can be arcuate or any other shape such as an "X", a line, etc. added within the central portion of the toilet seat cover, so that the toilet seat cover sheet will be more rapidly flushed down the toilet bowl because toilet water can be flushed through the perforation. The perforation can have at least two discrete sections.

It is a further object of the present invention to provide an additional perforation which can be arcuate or any other shape such as an "X", a line, etc. and consists of multiple discrete sections added within the central portion of the toilet seat cover, so that the toilet seat cover sheet will be more rapidly flushed down the toilet bowl because toilet water can be flushed through the perforations.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
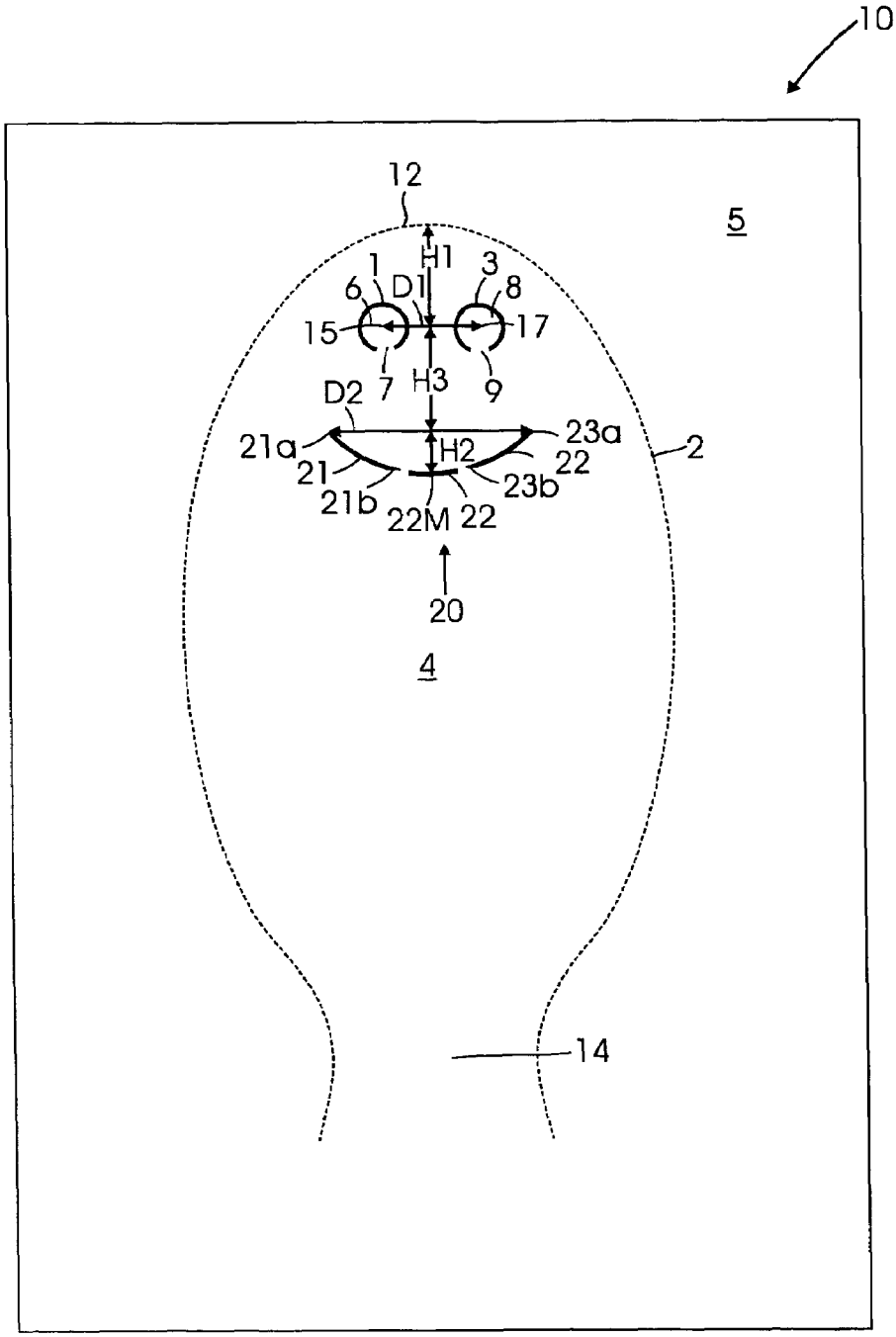
FIG. 1 is a plan view of the present invention paper sheet for use as a toilet seat cover according to a preferred embodiment of the invention wherein a pair of finger holes and an additional discrete arcuate perforation are placed into a central portion of the sheet.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is an improvement to resolve deficiencies in prior art toilet seat covers by adding a pair of finger holes which are not cut in 360 degrees and an additional discrete arcuate perforation into a central portion of a die cut paper sheet which is used as a toilet seat cover, wherein the holes enable the central portion to be effectively gripped by insertion of one or two fingers of a hand into a respective finger hole which increases its strength due to the retained portion to apply a force to the sheet so that the entire central portion can be easily and quickly torn away from rest of the sheet, and the additional arcuate perforation will enable the toilet seat cover sheet to be more efficiently and rapidly flushed down the toilet bowl.

Referring to FIG. 1, there is illustrated one preferred embodiment 10 of the present invention improved disposable paper sheet used as a toilet seat cover. The sheet 10 has a generally rectangular shape, comprising a die cut line 2 shaped as an open ended oval, wherein the die cut line comprises a plurality of fine discrete slits with a fine distance between two adjacent slits. The die cut line 2 further defines a central elongated ovally shaped portion 4, and an outer seat covering portion 5 of the paper sheet 10. The central portion comprises an oval area with the oval end 12 and a distal section 14 along a longitudinal direction of the elongated ovally shaped central portion 4.

Referring further to FIG. 1, a pair of finger holes 6 and 8 having a respective center 15 and 17 are illustrated. Each finger hole 6 and 8 is not to cut in a three-sixty (360) degree circle but each has a respective portion 7 and 9 that is uncut and thereby retained onto the central portion 4. Each hole 6 and 8 has a respective curved cut line 1 and 3 that separates a majority of the holes 6 and 8 from the central portion 4. It will be appreciated that the retained portions 7 and 9 increases the strength of the finger holes if one or two fingers of a user are inserted into the holes for the purpose of gripping the holes. The finger holes 6 and 8 are preferably located transversely and symmetrically along an imaginary centerline of the elongated central portion 4, wherein the imaginary centerline is aligned with the oval end 12 of the central portion 4 and further aligned with a longitudinal centerline of the rectangular sheet 10.

In the preferred embodiment, the pair of finger holes 6 and 8 having a diameter of 22 mm, and preferably have a vertical distance "H1" of 41 mm from the oval end 12 of the central portion 4. The vertical distance "H1" is a length from the oval end 12 to a cross point that is represented by a line "D1" which perpendicularly intercepts the imaginary centerline of the central portion 4, which line "D1" starts from the center 15 of the hole 6 and ends with the center 17 of the hole 8, and has a preferred length of 32 mm.

In the presence of the finger holes, the user can grip the finger holes 6 and 8 by placing a respective one or two fingers into a respective finger hole and apply a force to more easily separate the entire central elongated ovally shaped portion 4 away from the outer seat covering portion 5 through tearing the die cut line 2 due to the increased strength of the holes from the retained portions 7 and 9. The outer seat covering portion 5 then can be placed to rest on and cover the toilet seat, while the central portion 4 with the oval end 12 extends downwardly into a toilet bowl while the distal section 14 links the central portion 4 to the outer seat covering portion 5. The central elongated ovally shaped portion 4 also serves to carry the sheet off when the toilet is flushed, wherein the paper sheet used in the present invention is a preferred type suitable for flushing after use so that the entire paper sheet can be disposed of into the toilet.

Referring to FIG. 1 again, the preferred embodiment of the present invention toilet seat cover 10 further includes an additional discrete arcuate perforation 20. The curved perforation 20 is placed below the paired finger holes 6 and 8, and is transversely and symmetrically intercepted with the imaginary centerline of the central portion 4. The arcuate perforation 20 is convex relative to the oval end 12, which therefore gives it the appearance of a cartoon of "smile", and is further comprised of a respective first, middle and third discrete arcuate section 21, 22, and 23 in series. The arcuate section 21 has a first and second end 21*a* and 21*b* is a mirror image to the arcuate section 23 with first and second end 23*a* and 23*b*, relative to the imaginary centerline of the central portion 4. The middle arcuate section 22 is transversely and symmetrically intercepted by the imaginary centerline of the central portion 4.

The arcuate perforation 20 is further illustrated to have a preferred length "D2" of 90 mm, which is the length connected between the first end 21*a* and 23*a* of the respective first and third arcuate section 21 and 23, and a preferred height "H2" of 20 mm, which is the vertical distance between a center point of the second arcuate portion 22 to the line "D2". The arcuate perforation 20 is placed below the paired finger holes 6 and 8 with a vertical distance "H3" of 41 mm, which is the vertical distance between the line "D1" to "D2". It will be appreciated that in the presence of the arcuate perforation 20, the toilet seat cover sheet will be more efficiently and rapidly flushed down the toilet bowl because the toilet water can pass through the perforation, which promotes a rapid flush of the cover sheet.

It will be appreciated that, in the presence of the ovally shaped dotted cut line 2, the paired finger holes 6 and 8, and the convex arcuate perforation 20, the present invention toilet seat cover looks like a cartoon of a smiley face. With respect to the above description of the preferred embodiment, it is to be realized that the core structural improvement of the present invention is the addition of the paired finger holes and arcuate perforation. Therefore, in accordance with the core technology, various variations in size, shape, structural feature, and dimensional location are readily available for the structural components of the holes and arcuate perforation in the present invention.

For example, the paired finger holes are not limited to be located close to the oval end of the central portion of the paper sheet. The finger holes can be located at any location in the central portion 4 as long as the central portion can be easily and quickly torn from the outer seat covering portion 5 when the finger holes are used for the tearing purpose. Further, the finger holes should be in the body portion 4 and not adjacent the die-cut line 2 because placing the holes adjacent to the die-cut line will cause the hole to disappear once the central portion 4 is torn away from the die-cut line 2. It is also within the spirit and scope of the present invention to have at least one finger hole in the central portion 4 for the purpose of effectively separating the central portion 4 from the outer seat covering portion 5 of the paper sheet 10.

With respect to the position for the arcuate perforation to be placed within the central portion 4, it can be varied to located at any position and not only the transverse position of the arcuate perforation 20 relative to the imaginary centerline disclosed in FIG. 1. In addition, variations of the multiplicity of the discrete sections of the perforation are also available.

In addition, the present invention includes the concept of having the additional perforation 20 to enable water to flow through the perforation to facilitate flushing. While the arcuate smile in separate sections is the preferred embodiment, its is within the spirit and scope of the present invention to have a perforation which is a continuous arcuate line in the shape of a smile or to have any other perforation such as a straight line, an "X", or any other perforation within the central portion 4 so that water can pass through the portion during flushing to facilitate more rapid flushing of the toilet seat cover 10 after it has been used. In addition, the perforation can have at least two discrete sections.

It will be additionally appreciated that the present invented paper sheet for use as the toilet seat cover is not limited to be rectangular in shape. For example, an annular shape is also effective. Any shape of the paper sheet can be effective for the present invention as long as the outer seat covering portion can rest on and cover the toilet seat. For the same reason, the central portion of the paper sheet is not limited to be the oval shape but can be any appropriate shape, such as a "U" shape. Therefore, it will be appreciated that the present invention paper sheet for use as the toilet seat cover is not limited to be the rectangular shape.

Defined in detail, the present invention is a paper sheet used as a toilet seat cover, comprising: (a) a generally rectangular shaped sheet of paper which is suitable for flushing into a toilet after use and having a die cut line shaped as an oval that divides the paper sheet into a central elongated ovally shaped portion and an outer seat covering portion; (b) the central elongated ovally shaped portion having an oval area remote from a distal section by which it is attached to the paper sheet having a pair of spaced apart finger holes and a discrete arcuate perforation consisting of three discrete sections transversely extending through the oval area and symmetrically located along an imaginary longitudinal centerline of the oval area, the imaginary longitudinal centerline is further aligned with a longitudinal centerline of the paper sheet, wherein the finger holes are not fully cut in 360 degrees but have a portion that is retained onto the central portion of the paper sheet, the finger holes being positioned closer to an end of the oval area than said arcuate perforation to thereby form a smiley face; and (c) through use of a respective one or two fingers of a hand, the finger is respectively inserted into a respective one of the finger holes and used to tear the oval area along the die-cut line to efficiently separate the oval area from the remainder of the sheet, so that when the covering portion is placed over a toilet seat, the elongated oval area hangs down into a toilet bowl and remains connected to the covering section by its distal section, and the presence of the arcuate perforation enables the toilet seat cover sheet to be more rapidly flushed down the toilet bowl because water flows through the perforation during flushing.

Defined more broadly, the present invention is a paper sheet used as a toilet seat cover, comprising: (a) a sheet of paper having an interior die cut line which divides the paper sheet into a central portion within the die-cut line and an outer seat covering portion; (b) said central portion having a body area and a distal section by which the body is attached to the sheet of paper, the body area having a pair of spaced apart finger holes which are not fully cut in 360 degrees so that a portion of each finger hole is retained on the body area, and an arcuate perforation transversely extending through the body area; and (c) through use of at least one finger of a hand inserted into a respective one of the two finger holes, the holes are used to tear the body area along the die-cut line to efficiently separate the body area from the remainder of the sheet, so that when the covering portion is placed over a toilet seat, the body area hangs down into a toilet bowl and remains connected to the covering section by its distal section, and because of the presence of the arcuate perforation, the toilet seat cover sheet will be more rapidly flushed down the toilet bowl because water flows through the perforation.

Defined even more broadly, the present invention is a paper sheet used as a toilet seat cover, comprising: (a) a sheet of paper having an interior die cut line which divides the paper sheet into a central portion within the die-cut line and an outer seat covering portion; (b) said central portion having a body area and a distal section by which the body area is attached to the sheet of paper, the body area having a pair of spaced apart finger holes which are not fully cut in 360 degrees so that a portion of each finger hole is retained on the body area, and a perforation extending through the body area; and (c) through use of at least one finger of a hand inserted into a respective one of the two finger holes, the holes are used to tear the body area along the die-cut line to efficiently separate the body area from the remainder of the sheet, so that when the covering portion is placed over a toilet seat, the body area hangs down into a toilet bowl and remains connected to the covering section by its distal section, and because of the presence of the perforation, the toilet seat cover sheet will be more rapidly flushed down the toilet bowl because water flows through the perforation.

Defined alternatively more broadly the present invention is a paper sheet used as a toilet seat cover, comprising: (a) a sheet of paper having an interior die cut line which divides the paper sheet into a central portion within the die-cut line and an outer seat covering portion; (b) said central portion having a body area and a distal section by which the body area is attached to the sheet of paper, the body area having at least one finger hole which is not fully cut in 360 degrees and an arcuate perforation extending through the body area; and (c) through use of a finger of a hand, the finger is inserted into the at least one finger hole and used to tear the body area along the die-cut line to separate the body area from the remainder of the sheet, so that when the covering portion is placed over a toilet seat, the body area hangs down into a toilet bowl and remains connected to the covering section by its distal section, and because of the presence of the arcuate perforation, the toilet seat cover sheet will be more rapidly flushed down the toilet bowl because water through the arcuate perforation.

Defined alternatively even more broadly, the present invention is a paper sheet used as a toilet seat cover, comprising: (a) a sheet of paper having an interior die cut line which divides the paper sheet into a central portion within the die-cut line and an outer seat covering portion; (b) said central portion having a body area and a distal section by which the body area is attached to the sheet of paper, the body area having at least one finger hole which is not fully cut in 360 degrees and a perforation extending through the body area; and (c) through use of a finger of a hand, the finger is inserted into the at least one finger hole and used to tear the body area along the die-cut line to separate the body area from the remainder of the sheet, so that when the covering portion is placed over a toilet seat, the body area hangs down into a toilet bowl and remains connected to the covering section by its distal section, and because of the presence of the perforation, the toilet seat cover sheet will be more rapidly flushed down the toilet bowl because water through the perforation.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A paper sheet used as a toilet seat cover, comprising:

a. a generally rectangular shaped individual sheet of paper which is suitable for flushing into a toilet after use and having a die cut line shaped as an oval that divides the paper sheet into a central elongated ovally shaped portion and an outer seat covering portion;

b. the central elongated ovally shaped portion having an oval area remote from a distal section by which it is attached to the paper sheet having a pair of spaced apart finger holes and a discrete arcuate perforation consisting of three discrete sections transversely extending through the oval area and symmetrically located along an imaginary longitudinal centerline of the oval area, the pair of spaced apart finger holes and the discrete arcuate perforation positioned at a location so that the finger holes and arcuate perforation are not connected to the die cut line and do not touch the die cut line, the imaginary longitudinal centerline is further aligned with a longitudinal centerline of the paper sheet, wherein the finger holes are not fully cut in a 360 degree circle but have a portion that is retained onto the central portion of the paper sheet, the finger holes being positioned closer to an end of the oval area than said arcuate perforation to thereby form a smiley face; and c. through use of a respective one or two fingers of a hand, the finger is respectively inserted into a respective one of the finger holes and used to tear the oval area along the die-cut line to efficiently separate the oval area from the remainder of the sheet, so that when the covering portion is placed over a toilet seat, the elongated oval area hangs down into a toilet bowl and remains connected to the covering section by its distal section, and the presence of the arcuate perforation enables the toilet seat cover sheet to be more rapidly flushed down the toilet bowl because water flows through the perforation during flushing.

2. A toilet seat cover in accordance with claim 1 wherein said each finger hole has increased strength due to the portion that is retained within the interior of the cover when the finger hole is gripped.

3. A paper sheet used as a toilet seat cover, comprising:

a. an individual sheet of paper having an interior die cut line which divides the paper sheet into a central portion within the die-cut line and an outer seat covering portion;

b. said central portion having a body area and a distal section by which the body is attached to the sheet of paper, the body area having a pair of spaced apart finger holes which are not fully cut in a 360 degree circle so that a portion of each finger hole is retained on the body area, and an arcuate perforation transversely extending through the body area, the pair of spaced apart finger holes and the arcuate perforation positioned so that the finger holes and arcuate perforation are not connected to the die cut line and do not touch the die cut line; and c. through use of at least one finger of a hand inserted into a respective one of the two finger holes, the holes are used to tear the body area along the die-cut line to efficiently separate the body area from the remainder of the sheet, so that when the covering portion is placed over a toilet seat, the body area hangs down into a toilet bowl and remains connected to the covering section by its distal section, and because of the presence of the arcuate perforation, the toilet seat cover sheet will be more rapidly flushed down the toilet bowl because water flows through the perforation.

4. A toilet seat cover in accordance with claim 3 wherein said two finger holes which have a portion that is retained onto the body area are symmetrically located within the body area along an imaginary longitudinal centerline of the body area, and each finger hole has increased strength due to the portion that is retained within the interior of the cover when the finger hole is gripped.

5. A toilet seat cover in accordance with claim 3 wherein said arcuate perforation is symmetrically and transversely located within the body area along an imaginary longitudinal centerline of the body area, and is at a location on the body area to form a smiley face with the two finger holes.

6. A toilet seat cover in accordance with claim 5 wherein said arcuate perforation further comprises three discrete arcuate sections.

7. A toilet seat cover in accordance with claim 3, wherein said pair of finger holes are located at any location of the body area so as not to touch the die-cut line.

8. A toilet seat cover in accordance with claim 3, wherein said arcuate perforation is located at any location of the body area so as not to touch the die-cut line.

9. A paper sheet used as a toilet seat cover, comprising:

a. an individual sheet of paper having an interior die cut line which divides the paper sheet into a central portion within the die-cut line and an outer seat covering portion;

b. said central portion having a body area and a distal section by which the body area is attached to the sheet of paper, the body area having a pair of spaced apart finger holes which are not fully cut in a 360 degree circle so that a portion of each finger hole is retained on the body area, and a perforation extending through the body area, the pair of spaced apart finger holes and the perforation positioned so that the finger holes and arcuate perforation are not connected to the die cut line and do not touch the die cut line; and c. through use of at least one finger of a hand inserted into a respective one of the two finger holes, the holes are used to tear the body area along the die-cut line to efficiently separate the body area from the remainder of the sheet, so that when the covering portion is placed over a toilet seat, the body area hangs down into a toilet bowl and remains connected to the covering section by its distal section, and because of the presence of the perforation, the toilet seat cover sheet will be more rapidly flushed down the toilet bowl because water flows through the perforation.

10. A toilet seat cover in accordance with claim 9 wherein said two finger holes which have a portion that is retained onto the body area are symmetrically located within the body area along an imaginary longitudinal centerline of the body area, and each finger hole has increased strength due to the portion that is retained within the interior of the cover when the finger hole is gripped.

11. A toilet seat cover in accordance with claim 9 wherein said perforation is symmetrically and transversely located within the body area along an imaginary longitudinal centerline of the body area.

12. A toilet seat cover in accordance with claim 9 wherein said perforation further comprises at least two discrete sections.

13. A toilet seat cover in accordance with claim 9, wherein said pair of finger holes are located at any location of the body area so as not to touch the die-cut line.

14. A toilet seat cover in accordance with claim 9, wherein said perforation is located at any location of the body area so as not to touch the die-cut line.

15. A paper sheet used as a toilet seat cover, comprising:

a. an individual sheet of paper having an interior die cut line which divides the paper sheet into a central portion within the die-cut line and an outer seat covering portion;

b. said central portion having a body area and a distal section by which the body area is attached to the sheet of paper, the body area having at least one finger hole which is not fully cut in a 360 degree circle and an arcuate perforation extending through the body area, the at least one finger hole and the arcuate perforation positioned so that the finger holes and arcuate perforation are not connected to the die cut line and do not touch the die cut line; and c. through use of a finger of a hand, the finger is inserted into the at least one finger hole and used to tear the body area along the die-cut line to separate the body area from the remainder of the sheet, so that when the covering portion is placed over a toilet seat, the body area hangs down into a toilet bowl and remains connected to the covering section by its distal section, and because of the presence of the arcuate perforation, the toilet seat cover sheet will be more rapidly flushed down the toilet bowl because water through the arcuate perforation.

16. A toilet seat cover in accordance with claim 15 wherein said at least one finger hole has a portion that is retained onto the body area is located within the body area, and said at least one finger hole has increased strength due to the portion that is retained within the interior of the cover when the finger hole is gripped.

17. A toilet seat cover in accordance with claim 15 wherein said arcuate perforation is symmetrically and transversely located within the body area along an imaginary longitudinal centerline of the body area, and is at a location on the body area to form a smiley face with the at least one finger hole.

18. A toilet seat cover in accordance with claim 15 wherein said arcuate perforation is comprised of multiple discrete arcuate sections.

19. A toilet seat cover in accordance with claim 15, wherein said at least one finger hole is located at any location of the body area so as not to touch the die-cut line.

20. A toilet seat cover in accordance with claim 15, wherein said arcuate perforation is located at any location of the body area so as not to touch the die-cut line.

21. A paper sheet used as a toilet seat cover, comprising:

a. an individual sheet of paper having an interior die cut line which divides the paper sheet into a central portion within the die-cut line and an outer seat covering portion;

b. said central portion having a body area and a distal section by which the body area is attached to the sheet of paper, the body area having at least one finger hole which is not fully cut in a 360 degree circle and a perforation extending through the body area, the at least one finger hole and the perforation positioned so that the finger holes and perforation are not connected to the die cut line and do not touch the die cut line; and c. through use of a finger of a hand, the finger is inserted into the at least one finger hole and used to tear the body area along the die-cut line to separate the body area from the remainder of the sheet, so that when the covering portion is placed over a toilet seat, the body area hangs down into a toilet bowl and remains connected to the covering section by its distal section, and because of the presence of the perforation, the toilet seat cover sheet will be more rapidly flushed down the toilet bowl because water through the perforation.

22. A toilet seat cover in accordance with claim 21 wherein said at least one finger hole has a portion that is retained onto the body area is located within the body area, and said at least one finger hole has increased strength due to the portion that is retained within the interior of the cover when the finger hole is gripped.

23. A toilet seat cover in accordance with claim 21 wherein said perforation is symmetrically and transversely located within the body area along an imaginary longitudinal centerline of the body area.

24. A toilet seat cover in accordance with claim 21 wherein said perforation is comprised of at least two discrete sections.

25. A toilet seat cover in accordance with claim 21, wherein said at least one finger hole is located at any location of the body area so as not to touch the die-cut line.

26. A toilet seat cover in accordance with claim 21, wherein said perforation is located at any location of the body area so as not to touch the die-cut line.

* * * * *